US008240830B2

(12) United States Patent
Jones et al.

(10) Patent No.: US 8,240,830 B2
(45) Date of Patent: Aug. 14, 2012

(54) NO SPILL, FEED CONTROLLED REMOVABLE CONTAINER FOR DELIVERING PELLETIZED SUBSTANCES

(75) Inventors: Brent R. Jones, Sherwood, OR (US); Frederick T. Mattern, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 250 days.

(21) Appl. No.: 12/721,312

(22) Filed: Mar. 10, 2010

(65) Prior Publication Data

US 2011/0221837 A1 Sep. 15, 2011

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS

| | | | |
|---|---|---|---|
| 3,286,862 | A | 11/1966 | Hansen |
| 3,556,418 | A | 1/1971 | Hokana |
| 3,642,254 | A | 2/1972 | Ternes |
| 3,913,794 | A | 10/1975 | Dale |
| 4,000,833 | A | 1/1977 | Marks |
| 4,164,327 | A | 8/1979 | Clark |
| 4,222,502 | A | 9/1980 | Gubitose et al. |
| 4,411,390 | A | 10/1983 | Woten |
| 4,569,462 | A | 2/1986 | Belokin |
| 4,589,576 | A | 5/1986 | Knight et al. |
| 4,636,803 | A | 1/1987 | Mikalsen |
| 4,846,381 | A | 7/1989 | Kito et al. |
| 5,020,240 | A | 6/1991 | Lee |
| 5,123,961 | A | 6/1992 | Yamamoto |
| 5,181,049 | A | 1/1993 | Mackay et al. |
| 5,223,860 | A | 6/1993 | Loofbourow et al. |
| 5,230,300 | A | 7/1993 | Mezhinsky |
| 5,276,468 | A | 1/1994 | Deur et al. |
| 5,299,711 | A | 4/1994 | Romick |
| 5,324,143 | A | 6/1994 | Sanders |
| 5,341,164 | A * | 8/1994 | Miyazawa et al. ..... 347/88 |

(Continued)

FOREIGN PATENT DOCUMENTS

EP 1 359 019 A1 11/2003

(Continued)

OTHER PUBLICATIONS

Office Action for U.S. Appl. No. 11/602,931, Mailed Jun. 9, 2009, United States Patent and Trademark Office (21 pages).

(Continued)

*Primary Examiner* — Matthew Luu
*Assistant Examiner* — Rut Patel
(74) *Attorney, Agent, or Firm* — Maginot, Moore & Beck, LLP

(57) ABSTRACT

A solid printer includes a solid ink container that expels solid ink units in predetermined amounts for delivery to a melting device within the printer. The solid ink container includes a housing in which solid ink pellets are stored, an opening in the housing through which solid ink units are expelled, a first moveable member located within the housing proximate to the opening, the first moveable member being configured to move solid ink units through the opening, and a second moveable member located within the housing, the second moveable member being configured to move solid ink pellets to the first moveable member to enable the first moveable member to expel solid ink pellets through the opening in the housing.

20 Claims, 4 Drawing Sheets

U.S. PATENT DOCUMENTS

| | | | | |
|---|---|---|---|---|
| 5,356,011 | A | 10/1994 | Romick | |
| 5,368,203 | A | 11/1994 | Friedrich et al. | |
| 5,379,915 | A | 1/1995 | Hudspeth et al. | |
| 5,386,224 | A | 1/1995 | Deur et al. | |
| 5,442,387 | A | 8/1995 | Loofbourow et al. | |
| 5,510,821 | A | 4/1996 | Jones et al. | |
| D371,157 | S | 6/1996 | Chambers | |
| D371,801 | S | 7/1996 | Jones et al. | |
| D371,802 | S | 7/1996 | Jones et al. | |
| D372,268 | S | 7/1996 | Jones et al. | |
| D372,270 | S | 7/1996 | Jones et al. | |
| D373,139 | S | 8/1996 | Jones et al. | |
| D379,470 | S | 5/1997 | Gilbert | |
| D379,471 | S | 5/1997 | Gilbert | |
| D379,639 | S | 6/1997 | Gilbert | |
| D379,640 | S | 6/1997 | Gilbert | |
| D380,771 | S | 7/1997 | Jones | |
| D383,153 | S | 9/1997 | Jones et al. | |
| D383,154 | S | 9/1997 | Jones et al. | |
| 5,689,288 | A | 11/1997 | Wimmer et al. | |
| 5,725,160 | A | 3/1998 | Harper et al. | |
| 5,734,402 | A | 3/1998 | Rousseau et al. | |
| 5,784,089 | A | 7/1998 | Crawford | |
| D402,308 | S | 12/1998 | Yao et al. | |
| D403,351 | S | 12/1998 | Yao et al. | |
| D403,352 | S | 12/1998 | Brown et al. | |
| D403,699 | S | 1/1999 | Chin et al. | |
| 5,861,903 | A | 1/1999 | Crawford et al. | |
| 5,873,226 | A | 2/1999 | McLeod | |
| D407,109 | S | 3/1999 | Yao et al. | |
| D407,110 | S | 3/1999 | Yao et al. | |
| D407,111 | S | 3/1999 | Brown et al. | |
| D407,742 | S | 4/1999 | Yao et al. | |
| D407,743 | S | 4/1999 | Yao et al. | |
| D407,745 | S | 4/1999 | Brown et al. | |
| D408,849 | S | 4/1999 | Chin et al. | |
| D409,235 | S | 5/1999 | Chin et al. | |
| D409,237 | S | 5/1999 | Ellers et al. | |
| D410,026 | S | 5/1999 | Brown et al. | |
| D410,490 | S | 6/1999 | Mattern et al. | |
| 5,917,528 | A * | 6/1999 | Grellmann et al. | 347/88 |
| D412,527 | S | 8/1999 | Ellers et al. | |
| D412,528 | S | 8/1999 | Ellers et al. | |
| D412,934 | S | 8/1999 | Jones | |
| 5,937,252 | A | 8/1999 | Peters, Jr. et al. | |
| D413,625 | S | 9/1999 | Brown et al. | |
| D414,200 | S | 9/1999 | Jones | |
| D415,193 | S | 10/1999 | Jones | |
| D416,936 | S | 11/1999 | Chin et al. | |
| 5,975,690 | A * | 11/1999 | Grellmann et al. | 347/88 |
| 5,988,805 | A | 11/1999 | Meinhardt | |
| 6,053,608 | A | 4/2000 | Ishii et al. | |
| 6,056,394 | A | 5/2000 | Rousseau et al. | |
| 6,088,219 | A | 7/2000 | Yanniello et al. | |
| 6,109,803 | A | 8/2000 | Yasui et al. | |
| D436,124 | S | 1/2001 | Mattern et al. | |
| D436,989 | S | 1/2001 | Mattern et al. | |
| D440,248 | S | 4/2001 | Mattern et al. | |
| D440,249 | S | 4/2001 | Ellers et al. | |
| 6,263,833 | B1 | 7/2001 | Runyan et al. | |
| 6,273,153 | B1 | 8/2001 | Reinsch | |
| D453,786 | S | 2/2002 | Mattern | |
| D453,787 | S | 2/2002 | Mattern | |
| 6,409,327 | B1 | 6/2002 | Koeleman et al. | |
| 6,422,694 | B1 | 7/2002 | Hollands | |
| 6,481,373 | B2 | 11/2002 | Swetzig | |
| 6,543,867 | B1 | 4/2003 | Jones | |
| 6,561,636 | B1 | 5/2003 | Jones | |
| 6,565,200 | B1 | 5/2003 | Jones | |
| 6,565,201 | B1 | 5/2003 | Jones | |
| 6,572,225 | B1 | 6/2003 | Jones | |
| D478,347 | S | 8/2003 | Jones | |
| D478,621 | S | 8/2003 | Jones | |
| D479,368 | S | 9/2003 | Jones | |
| D481,757 | S | 11/2003 | Jones | |
| D481,758 | S | 11/2003 | Jones | |
| D481,759 | S | 11/2003 | Jones et al. | |
| D482,062 | S | 11/2003 | Jones | |
| D482,063 | S | 11/2003 | Jones et al. | |
| D482,388 | S | 11/2003 | Jones | |
| D482,389 | S | 11/2003 | Jones | |
| D482,720 | S | 11/2003 | Jones et al. | |
| D482,721 | S | 11/2003 | Jones | |
| D482,722 | S | 11/2003 | Jones | |
| 6,648,435 | B1 | 11/2003 | Jones | |
| D483,062 | S | 12/2003 | Jones | |
| D483,063 | S | 12/2003 | Jones | |
| D483,404 | S | 12/2003 | Jones et al. | |
| 6,665,505 | B2 | 12/2003 | Meetze, Jr. et al. | |
| 6,672,716 | B2 | 1/2004 | Jones | |
| 6,679,591 | B2 | 1/2004 | Jones | |
| 6,705,710 | B2 | 3/2004 | Jones et al. | |
| 6,709,094 | B2 | 3/2004 | Jones | |
| 6,719,413 | B2 | 4/2004 | Jones | |
| 6,719,419 | B2 | 4/2004 | Jones et al. | |
| 6,722,764 | B2 | 4/2004 | Jones et al. | |
| 6,739,713 | B2 | 5/2004 | Jones et al. | |
| 6,746,113 | B1 | 6/2004 | Leighton et al. | |
| 6,755,517 | B2 | 6/2004 | Jones et al. | |
| 6,761,443 | B2 | 7/2004 | Jones | |
| 6,761,444 | B2 | 7/2004 | Jones et al. | |
| 6,824,241 | B2 | 11/2004 | Sonnichsen et al. | |
| D500,784 | S | 1/2005 | Jones et al. | |
| D500,785 | S | 1/2005 | Jones et al. | |
| 6,840,612 | B2 | 1/2005 | Jones et al. | |
| 6,840,613 | B2 | 1/2005 | Jones | |
| 6,857,732 | B2 | 2/2005 | Jones et al. | |
| 6,866,375 | B2 | 3/2005 | Leighton et al. | |
| 6,874,880 | B2 | 4/2005 | Jones | |
| 6,893,121 | B2 | 5/2005 | Jones | |
| 6,895,191 | B2 | 5/2005 | Rommelmann et al. | |
| D505,974 | S | 6/2005 | Jones et al. | |
| 6,905,201 | B2 | 6/2005 | Leighton | |
| 6,929,360 | B2 | 8/2005 | Jones | |
| 6,966,644 | B2 | 11/2005 | Jones et al. | |
| 6,981,754 | B2 | 1/2006 | Godil et al. | |
| 6,986,570 | B2 | 1/2006 | Jones et al. | |
| 7,017,624 | B2 | 3/2006 | Reinsch et al. | |
| 7,018,033 | B2 | 3/2006 | Joppen | |
| 7,048,123 | B2 | 5/2006 | Xiong et al. | |
| 7,063,412 | B2 | 6/2006 | Jones et al. | |
| 7,066,589 | B2 | 6/2006 | Jones et al. | |
| D524,370 | S | 7/2006 | Jones et al. | |
| 7,104,635 | B2 | 9/2006 | Jones | |
| D531,210 | S | 10/2006 | Jones | |
| D533,900 | S | 12/2006 | Jones et al. | |
| D535,327 | S | 1/2007 | Korn et al. | |
| D535,689 | S | 1/2007 | Jones et al. | |
| D537,116 | S | 2/2007 | Jones et al. | |
| 7,177,577 | B2 | 2/2007 | Ishiguro et al. | |
| 7,207,668 | B2 | 4/2007 | Jones et al. | |
| 7,263,317 | B2 | 8/2007 | Kubota et al. | |
| 7,302,212 | B2 | 11/2007 | Leute | |
| 7,380,928 | B2 | 6/2008 | Leighton | |
| 7,604,336 | B2 | 10/2009 | Leighton | |
| 7,887,173 | B2 * | 2/2011 | Jones | 347/88 |
| 2003/0202066 | A1 | 10/2003 | Jones | |
| 2003/0202067 | A1 | 10/2003 | Jones et al. | |
| 2003/0202069 | A1 | 10/2003 | Jones | |
| 2003/0202070 | A1 | 10/2003 | Jones | |
| 2003/0202071 | A1 | 10/2003 | Jones et al. | |
| 2003/0202074 | A1 | 10/2003 | Jones | |
| 2003/0202075 | A1 | 10/2003 | Jones | |
| 2003/0202077 | A1 | 10/2003 | Jones et al. | |
| 2003/0222930 | A1 | 12/2003 | Jones | |
| 2003/0222951 | A1 | 12/2003 | Jones | |
| 2003/0222952 | A1 | 12/2003 | Jones | |
| 2003/0222953 | A1 | 12/2003 | Jones | |
| 2003/0222954 | A1 | 12/2003 | Jones et al. | |
| 2003/0222955 | A1 | 12/2003 | Jones | |
| 2004/0160498 | A1 | 8/2004 | Jones | |
| 2004/0179074 | A1 | 9/2004 | Jones et al. | |
| 2004/0183875 | A1 | 9/2004 | Jones et al. | |
| 2005/0007428 | A1 | 1/2005 | Joppen | |
| 2005/0063820 | A1 | 3/2005 | Awdalla | |
| 2005/0146584 | A1 | 7/2005 | Godil et al. | |
| 2005/0151814 | A1 | 7/2005 | Wong et al. | |

| | | | |
|---|---|---|---|
| 2005/0207795 | A1 | 9/2005 | Kubota et al. |
| 2007/0153068 | A1 | 7/2007 | Jones et al. |
| 2008/0117264 | A1 | 5/2008 | Fairchild et al. |
| 2008/0117265 | A1 | 5/2008 | Esplin et al. |
| 2008/0117266 | A1 | 5/2008 | Esplin et al. |
| 2008/0117267 | A1 | 5/2008 | Fairchild et al. |
| 2008/0122907 | A1 | 5/2008 | Jones |
| 2008/0136881 | A1 | 6/2008 | Fairchild et al. |
| 2008/0136882 | A1 | 6/2008 | Fairchild et al. |
| 2008/0218572 | A1 | 9/2008 | Fairchild et al. |
| 2008/0264963 | A1 | 10/2008 | Teodorescu |
| 2009/0207219 | A1 | 8/2009 | Jones et al. |

FOREIGN PATENT DOCUMENTS

| | | | |
|---|---|---|---|
| JP | 11-115213 | A1 | 4/1999 |

OTHER PUBLICATIONS

Amendment in Response to Office Action for U.S. Appl. No. 11/602,931, submitted Sep. 8, 2009 (17 pages).
Final Office Action for U.S. Appl. No. 11/602,931 Mailed Jan. 5, 2010, United States Patent and Trademark Office (21 pages).
Amendment accompanying a Request for Continued Examination for U.S. Appl. No. 11/602,931, submitted Apr. 5, 2010 (9 pages).
Second Office Action for U.S. Appl. No. 11/602,931, Mailed Jun. 22, 2010, United States Patent and Trademark Office (9 pages).
Office Action for U.S. Appl. No. 11/602,937, Mailed Sep. 21, 2009, United States Patent and Trademark Office (7 pages).
Amendment in Response to Office Action for U.S. Appl. No. 11/602,937, submitted Dec. 21, 2009 (8 pages).
Office Action for U.S. Appl. No. 11/602,937, Mailed Apr. 14, 2010, United States Patent and Trademark Office (8 pages).
Amendment accompanying a Request for Continued Examination for U.S. Appl. No. 11/602,937, submitted Apr. 23, 2010 (9 pages).
Office Action for U.S. Appl. No. 11/602,710, Mailed Aug. 11, 2009, United States Patent and Trademark Office (7 pages).
Amendment in Response to Office Action for U.S. Appl. No. 11/602,710, submitted Nov. 12, 2009 (13 pages).
Final Office Action for U.S. Appl. No. 11/602,710, Mailed Mar. 5, 2010, United States Patent and Trademark Office (7 pages).
Amendment accompanying a Request for Continued Examination for U.S. Appl. No. 11/602,710, submitted Apr. 23, 2010 (5 pages).
Second Office Action for U.S. Appl. No. 11/602,710, Mailed May 13, 2010, United States Patent and Trademark Office (8 pages).
Office Action for U.S. Appl. No. 11/602,938, Mailed Aug. 7, 2009, United States Patent and Trademark Office (10 pages).
Amendment in Response to Office Action for U.S. Appl. No. 11/602,938, submitted Sep. 2, 2009 (29 pages).
Office Action for U.S. Appl. No. 12/016,675, Mailed May 10, 2010, United States Patent and Trademark Office (10 pages).
Amendment in Response to Office Action for U.S. Appl. No. 12/016,675, submitted Jul. 12, 2010 (7 pages).
Final Office Action for U.S. Appl. No. 12/016,675, Mailed Sep. 28, 2010, United States Patent and Trademark Office (10 pages).
Amendment in Response to Final Office Action for U.S. Appl. No. 12/016,675, submitted Oct. 15, 2010 (10 pages).
Amendent in Response to Second Non-final Office Action for U.S. Appl. No. 11/602,931, submitted Aug. 23, 2010 (5 pages).
Mailed Sep. 28, 2010, United States Patent and Trademark Office (10 pages).Second Final Office Action for U.S. Appl. No. 11/602,931, Mailed Nov. 15, 2010, United States Patent and Trademark Office (8 pages).
Amendment accompanying Second Request for Continued Examination for U.S. Appl. No. 11/602,931, submitted Jan. 18, 2011 (7 pages).
Amendment in Response to Second Non-Final Office Action for U.S. Appl. No. 11/602,710, submitted Jul. 13, 2010 (6 pages).

* cited by examiner

NO SPILL, FEED CONTROLLED REMOVABLE CONTAINER FOR DELIVERING PELLETIZED SUBSTANCES

CROSS-REFERENCE TO RELATED APPLICATIONS

Cross reference is made to the following application: U.S. Ser. No. 12/016,675 entitled "Transport System Having Multiple Moving Forces For Solid Ink Delivery In A Printer," which was filed on Jan. 18, 2008, and which is owned by the assignee of the subject matter described below and is expressly incorporated herein by reference.

TECHNICAL FIELD

The transport system disclosed below generally relates to solid ink printers, and, more particularly, to solid ink printers that uses solid ink pellets.

BACKGROUND

Solid ink or phase change ink imaging devices, hereinafter called solid ink printers, encompass various imaging devices, such as printers and multi-function devices. These printers offer many advantages over other types of image generating devices, such as laser and aqueous inkjet imaging devices. Solid ink or phase change ink printers conventionally receive ink in a solid form, which is typically a block form known as ink sticks. A color printer typically uses four colors of ink (yellow, cyan, magenta, and black).

The solid ink sticks, hereafter referred to as ink, sticks, or ink sticks, are delivered to a melting device, which is typically coupled to an ink delivery system, commonly referred to as a loader for conversion of the solid ink to a liquid. A typical ink loader includes multiple feed channels, one for each color of ink used in the imaging device. The ink for a particular color is placed in an insertion opening in the feed channel and then either gravity fed or urged by a conveyor or spring loaded pusher along the feed channel toward the melting device. The melting device heats the solid ink impinging on it and melts it into a liquid for delivery to a print head for jetting onto a recording medium or intermediate transfer surface.

The operational speed of solid ink printers has increased in order to produce higher output rates for printed copies. As the output rates have increased so has the demand for melted ink within the printer. In an effort to reduce the melting time for solid ink sticks or pellets, the surface area of an ink stick or pellet that contacts a melting device has been increased. One way of increasing the surface area of solid ink sticks or pellets has been to make the pellets smaller. These smaller pellets, however, are not as easily handled by users as solid ink sticks that are typically the size of a wooden building block or larger. As the pellets approach the size of a small marble, BB, large grain, or the like, they are better stored in containers that can be opened and their contents emptied into a hopper within the machine, for example. Pellets would be stored in a cartridge, which may also be a component of an ink delivery system. One advantage of a cartridge is that ink particulates and smears that can affect ink feed reliability can be mitigated with replacement of the cartridge multiple times over the life of the product.

Solid ink printers significantly differ from ink cartridge or toner printers because they need not be exhausted before additional solid ink is added to the feed channel. Specifically, ink cartridges and toner cartridges should be exhausted before another cartridge is installed so as not to waste ink or toner in a partially emptied cartridge. These cartridges may be typically returned to the manufacturer or other source to be refilled. Solid ink, on the other hand, may be stored on the premises and installed a stick at a time or as a group of pellets. Because the entire solid ink unit is consumed in the printing process, no housing or other component survives for disposal or return to the manufacturer.

The requirement that solid ink remains solid until impinging upon the melting assembly does present some challenges not present in ink cartridge and toner cartridge printers. Because the ink loader is above the ambient room temperature, the ink softens. The softened ink requires more force to be applied to the ink to overcome the increased friction. Additionally, a limit exists for the temperature level in an ink loader in order to prevent the ink from becoming too soft and losing its shape in the loader.

Containers for holding and dispensing solid ink from the ink loader, particularly pelletized solid ink, face some challenges. Traditional containers for pelletized material have been sealed at the time of manufacture such that they are only useful until the material has been dispensed. Once these containers are used, they become environmental waste with which an end-user must contend. Utilizing pelletized solid ink in larger products, such as a tabloid sized printer, is facilitated by employing very large containers and potentially multiple containers for some or all of the colors. These containers would be consistent with the space available in larger imaging products and the generally greater print volume they produce. These large machines are often placed under a lease agreement that includes a process for ink replacement and/or cartridge exchange. Smaller solid ink desk top printers and multi-function printers (MFPs) present a greater challenge in using pelletized ink supplied in cartridges Ink cartridges must not be so large that the purchase price presents an obstacle to users with lower volume demands. The cartridges may have to be replaced prior to being fully depleted to continue printing, as is common to toner cartridges, so some small remaining ink volume may remain in the cartridge when the cartridge is removed from the product for replacement. This ink could easily escape the cartridge through the exit port that enables the ink pellets to enter the ink delivery system. The warm printer environment encourages solid ink to become sticky such that force is usually required for the feeding of the ink. Small cartridges can be designed to be refilled but the present objective of cartridge mechanisms is to ensure reliable, consistent feed and not be prone to disagreeable leakage when removed from the printer. These issues present challenges that previous solutions have not addressed.

SUMMARY

The limitations on storing and delivering pelletized solid ink to a melting device for a solid ink printer have been addressed by a container that uses a motive force to deliver solid ink pellets to a gate that controls the release of the solid ink pellets to an external ink delivery or melting device of a solid ink printer. The pellet container includes a housing having an opening through which multiple solid ink pellets are expelled, a first moveable member located within the housing proximate to the opening, the first moveable member being configured to move solid ink units through the opening, and a second moveable member located within the housing, the second moveable member being configured to move solid ink pellets within the housing to the first moveable member for expulsion from the housing through the opening in the housing by the first moveable member.

A solid ink printer incorporates a solid ink container that enables replacement of the container without loss of solid ink pellets from the container. The printer includes a melting device configured to melt solid ink pellets and produce liquid ink for printing, and a solid ink container, the solid ink container being configured to mount selectively to the solid ink printer and further including a housing having a volume in which solid ink pellets are stored, an opening in the housing through which solid ink pellets are expelled for delivery of the solid ink pellets to the melting device, a first moveable member located within the housing proximate to the first opening, the first moveable member being configured to move solid ink pellets through the opening in the housing, and a second moveable member configured to move solid ink pellets within the housing to the first moveable member for expulsion from the housing through the opening in the housing by the first moveable member.

BRIEF DESCRIPTION OF THE DRAWINGS

Features for transporting solid ink in a solid ink printer are discussed with reference to the drawings, in which.

DETAILED DESCRIPTION

The term "printer" refers, for example, to reproduction devices in general, such as printers, facsimile machines, copiers, and related multi-function products. While the specification focuses on a system that transports solid ink through a solid ink printer, the transport system may be used with any solid ink image generating device. The cartridge of the present device is described as containing and feeding solid ink in the form of pellets. As used in this context, the term pellet or pellets refers to small chunks, rounds, pastilles, or granular ink where the material could flow out of a common liter size container rather having to be picked up and placed individually by a user.

Figure 1:
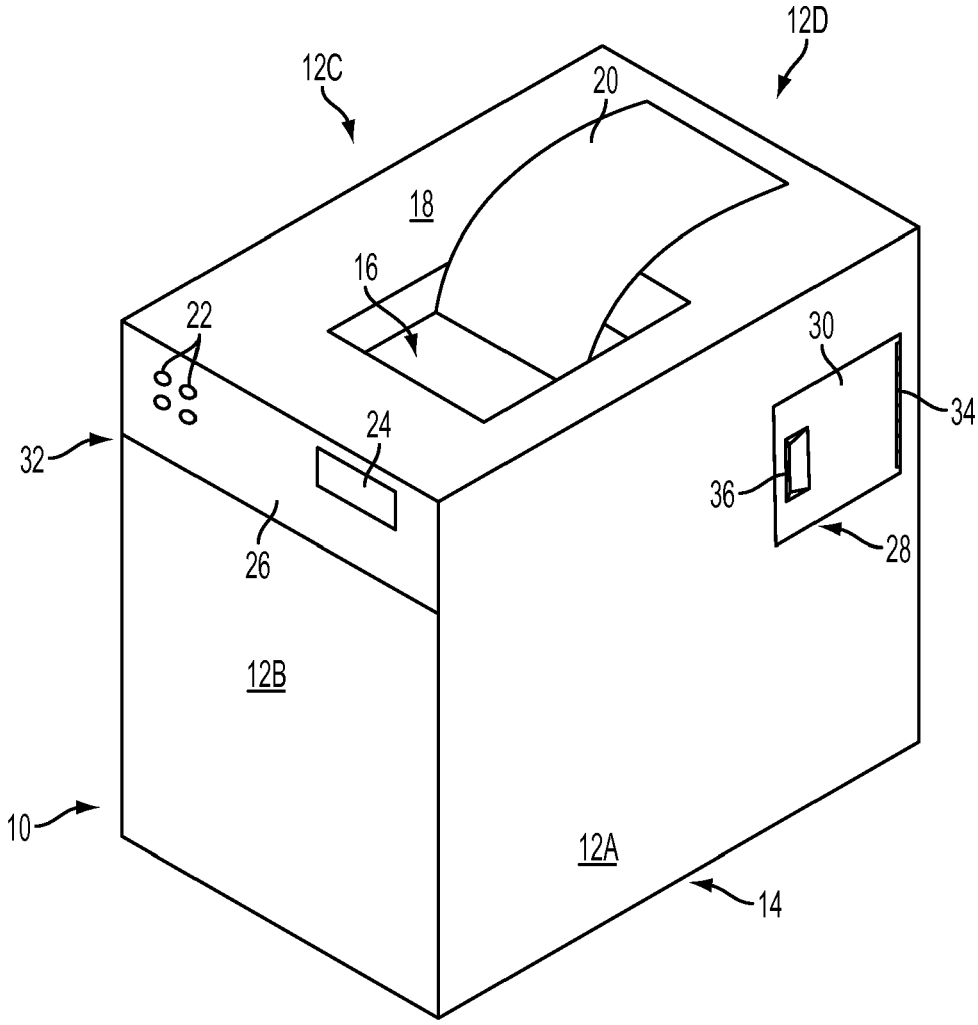
FIG. 1 is a perspective view of a solid ink printer incorporating the solid ink container shown in FIG. 2.

An exemplary solid ink printer having a solid ink transport system described in this document is shown in FIG. 1. The printer 10 includes a housing 32 having four vertically standing side walls 12A, 12B, 12C, and 12D, a bottom surface 14, and a top surface 18. Although the printer 10 is depicted in a shape that may be described as a rectangular solid, other shapes are possible. Additionally, the surfaces of the housing need not be planar and may include depressions and/or protrusions to accommodate internal components or enhance the visibility of external features. The housing may also include a control panel 26 having a display 24 and one or more function keys 22 or other control actuators or indicators.

The upper surface 18 of the housing 32 may include, for example, an output tray 16. Recording media, such as a paper sheet 20, exit the housing 32 and rest in the output tray 16 until retrieved by a user or operator. The housing 32 may include a media supply tray (not shown) from which recording media may be removed and processed by the printer 10. While the output tray 16 is shown as being in the upper surface 18 of the housing 32, other positions are possible, such as extending from rear wall 12D or one of the other side walls.

Figure 2:
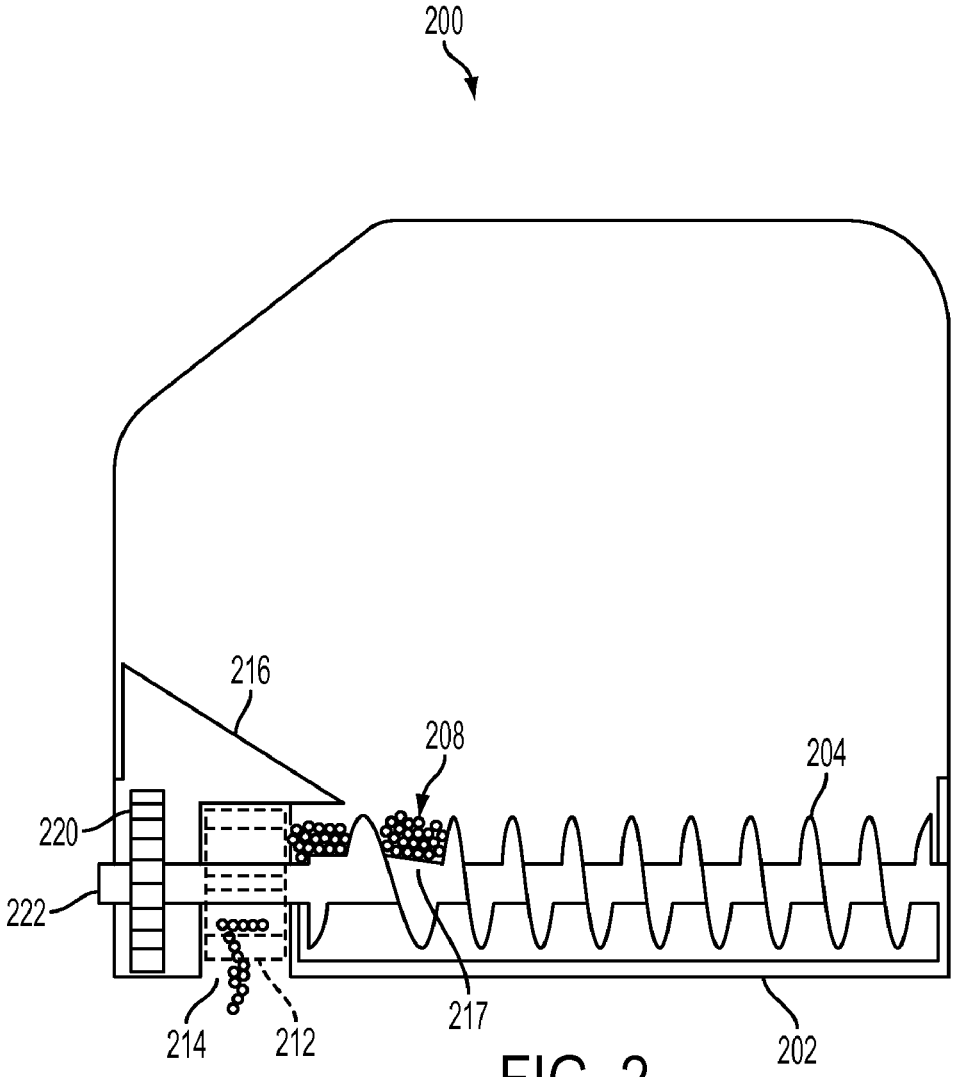
FIG. 2 is a cross-sectional view of a solid ink container that may be used with the printer shown in FIG. 1.
Figure 3:
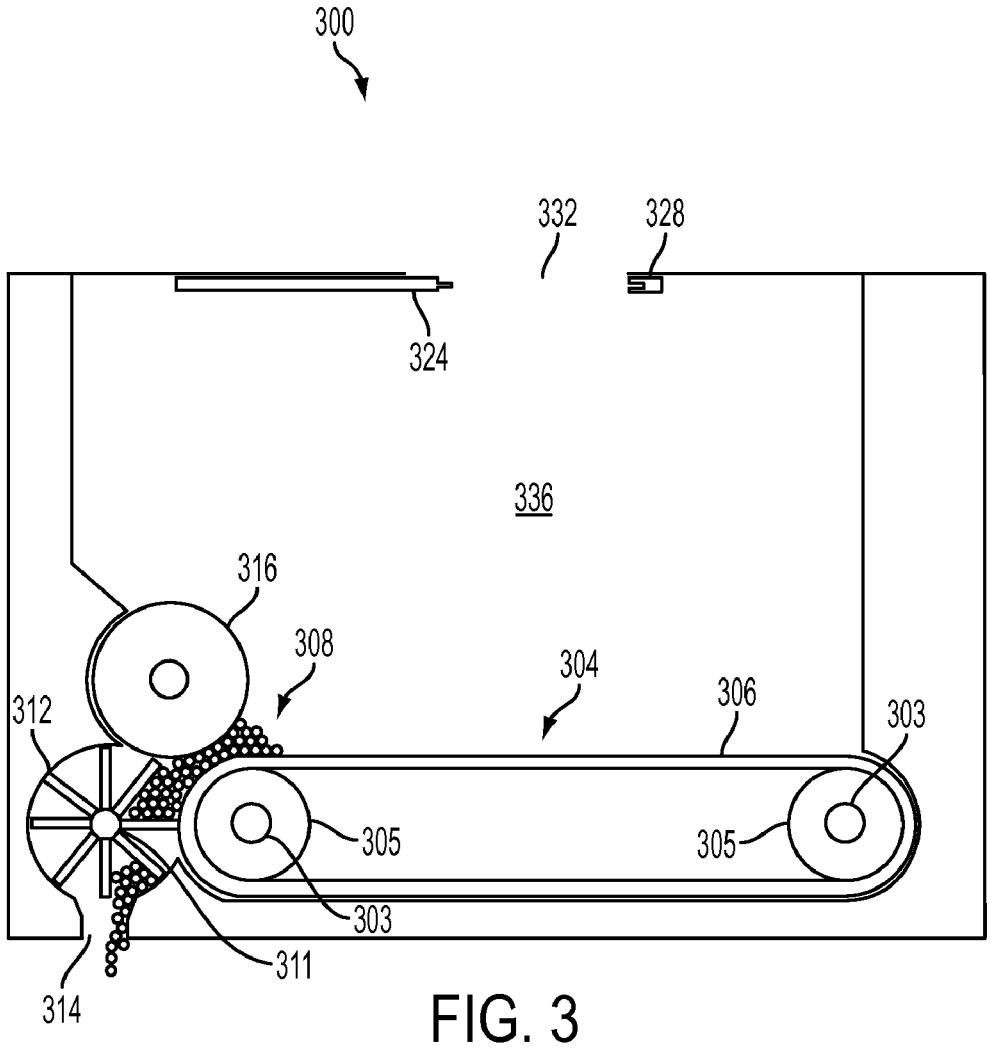
FIG. 3 is a cross-sectional view of another embodiment of a solid ink container that may be used with the printer shown in FIG. 1, in this configuration an optional refill opening is included.

As shown in FIG. 1, an enclosed ink loader 28 includes an access door 30 in the housing 32. Although the door 30 is depicted as being in the side wall 12A, it may be located in one of the other side walls or in the upper surface 18. Door 30 may be opened by the user of printer 10 to insert or remove a solid ink container such as depicted in FIG. 2 and FIG. 3 below. The example embodiment depicts door 30 opening on hinges 34, with a handle 36 allowing the user to engage the door 30. Many alternative embodiments of the ink loader 28 are envisioned. Some include a door that is slidably opened and closed or pivoted from an upper or lower hinge. Additionally, a locking mechanism may be included in embodiments where access to the solid ink container is restricted. In other embodiments, the ink loader may be positioned on the exterior of the housing 32 or otherwise mounted outside of the housing.

An example embodiment of an ink container that may be used with the printer 10 of FIG. 1 is depicted in FIG. 2. The ink container 200 includes an auger 204 that has a central axle 222 rotationally mounted to a housing 202. The rotating auger 204 acts as a conveyor, moving solid ink pellets 208 towards a vaned rotor 212. In the embodiment of FIG. 2, vaned rotor 212 is coaxially mounted to the central axle 222, and rotates in the same direction as the auger 204. When vaned rotor 212 rotates, ink pellets 208 are deposited in the chambers between each vane, and as vaned rotor 212 rotates past ink exhaust opening 214, the solid ink pellets 208 exit the ink container 200. In order to regulate the number of ink pellets 208 being conveyed to each chamber in vaned rotor 212, a restrictor ledge 216 is placed over vaned rotor 212. The restrictor ledge 216 relieves pressure on the solid ink pellets 208 and helps prevent the ink pellets from jamming vaned rotor 212. The auger 204 is tapered as shown at 217 at the portion of auger 204 proximate the restrictor ledge 216 and the vaned rotor 212. This structure helps reduce the number of pellets presented to the chambers of the rotor 212 and also reduces pressure on the pellets being carried by the auger to minimize the opportunity for jamming. When the central axis is not rotating, the vanes of rotor 212 act as a closed gate. The closed gate prevents solid ink pellets 208 from leaking out of ink exhaust opening 214 when the container is removed. In operation, the central axle 222, auger 204, and vaned rotor 212 are rotated by an external actuator (shown in FIG. 4) that engages with a drive coupler 220 to selectively dispense solid ink pellets 208 from the container 200. The auger and vaned rotor may be driven as a unit or independently at equivalent or different speeds or for equivalent or different time periods.

An alternative embodiment of an ink container that may be used with the printer 10 of FIG. 1 is depicted in FIG. 3. The ink container 300 includes a conveyor assembly 304 that includes an endless conveyor belt 306 rotated by cogs 305. While the conveyor belt 306 depicted in FIG. 3 is smooth, alternative belts could have textured corrugated surfaces that aid in conveying the ink pellets. The conveyor assembly 304 conveys solid ink pellets 308 towards a vaned rotor 312. In the embodiment of FIG. 3, the rotation axis of the vaned rotor 312 is oriented transversely to the direction of pellet movement along the conveyor belt 306. When the vaned rotor 312 rotates, ink pellets 308 are deposited in the chambers between each vane, and as vaned rotor 312 rotates past ink exhaust opening 314, the solid ink pellets 308 exit the ink container 300. In order to regulate the number of ink pellets 308 being conveyed to each chamber in vaned rotor 312, a restrictor wheel 316 is positioned above the opening leading to the vaned rotor 312. The restrictor wheel limits the amount of space available to the solid ink pellets 308 as they enter a chamber of the vaned rotor 312. The restrictor wheel 316 relieves pressure on the ink pellets being directed to the vane and so reduces the packing force on the pellets. This reduction mitigates the possibility of the pellets clogging the ink exhaust opening 314. In one embodiment, the restrictor wheel 316 is compliant and may be discontinuous, with vanes, for example. The wheel 316 may also be formed from a flexible material, such as foam, in order to accommodate the solid ink pellets 308. When the vaned rotor 312 is not rotating, the vanes of vaned rotor 312 act as a closed gate, preventing solid ink pellets 308 from leaking out of ink exhaust opening 314. In operation, the central axle 311 of the vaned rotor, and the central axle 303 of at least one of the cogs 305 engages with an external actuator that selectively rotates the vaned rotor 312 and cogs 305, causing ink pellets 308 to be dispensed from ink exhaust port 314. The conveyer and vaned rotor may be driven as a unit or driven independently at equivalent or different speeds or for equivalent or different time periods.

Continuing to refer to FIG. 3, the ink pellets 308 are stored in a storage space 336. While the depiction of the example embodiment of FIG. 3 does not show a full ink container 300, the ink pellets may fill the storage space 336 up to the top ink loading opening 332. The cartridge shown in FIG. 3 includes an ink loading opening 332 that enables the ink container 300 to be refilled with solid ink pellets 308. A door 324 is slidably disposed across the ink loading opening 332 to allow an end user to open or close the ink container 300 for loading. When closed, the door 324 engages with a back stop 328, sealing the storage space 336. The arrangement of FIG. 3 allows for the ink container 300 to be refilled by the user at any time, including when the ink container 300 is partially full. Thus, an end user is able to remove the ink container 300 from the printer, "top off" the pellet supply stored in the container, and re-install the ink container 300 in the printer without losing pellets from the exit of the container. The loading door and refill function are optional and may or may not be an aspect of any configuration of an ink pellet cartridge.

The ink containers depicted in FIG. 2 and FIG. 3 are merely illustrative of possible embodiments for solid ink containers, and other variations are envisioned. For example, the covering the ink loading opening could use a hinged mechanism instead of a sliding mechanism. The opening could also include a threaded screw attachment designed to accept a cap or be configured to open only with specialized factory equipment to prevent unauthorized access. The refill door or opening may be associated with one or more structural features that enable access to the internal volume of the container only by damaging some portion of the cartridge assembly. Thus, replacement of one or more container components with new parts would be required after a refill with pellets. For example, some frangible component may be associated with the door that fractures upon the opening of the refill door. Various considerations including selections of materials used, operating temperatures, size and shapes of the solid ink pellets, friction between the ink pellets and container, desired ink pellet output rate, and the size and shape of the ink container may all affect the selection and configuration of the components used. Additionally, the cartridge may have aesthetic treatments if mounted so as to be visible in a normal printer operation state. The housing or any other cartridge element may be transparent, translucent or opaque and may be colored to indicate the general color of the ink.

Figure 4:
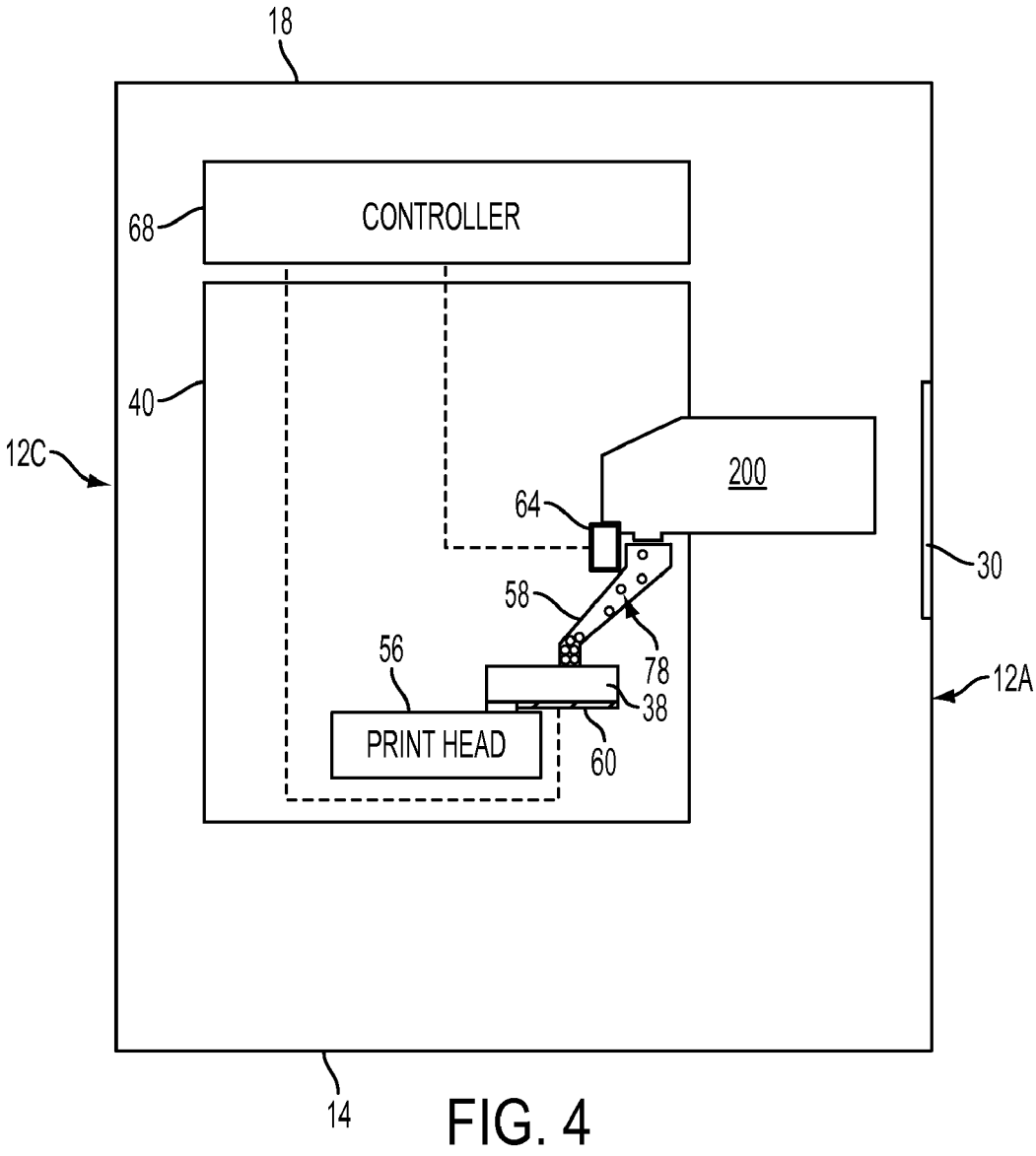
FIG. 4. is a front cross-sectional view of the printer shown in FIG. 1 front cross-sectional view of the printer shown in FIG. 1 incorporating the solid ink container of FIG. 2.

An internal view of the example printer 10 of FIG. 1 is depicted in FIG. 4. The print engine 40 includes the imaging system with print head 56, and other various subsystems, such as the internal media transport and imaging surface maintenance systems (not shown). The ink cartridge outlet path 58 is coupled at one end to the ink container 200 and at the other end to an ink melting assembly 38. The ink outlet path 58 may be configured as a tube, which can be of any functional cross sectional shape, or a trough, for example, to contain the solid ink pellets 78 as they move along the ink outlet path 58. As shown in FIG. 2, the ink outlet path is oriented so it uses a gravity feed employing a vertical drop. This vertical drop may be at an angle with respect to the bottom surface 14 or it may be essentially a straight drop towards the bottom surface. The vertical drop helps ensure that gravity is the primary or most significant influencing force that moves the solid ink from the ink container 200 to the melt device 60. Gravity feed as used herein refers to a force that moves solid ink with gravity alone or that uses gravity to augment another motive force acting on the solid ink or that enables another motive force to move solid ink along a path.

Continuing to refer to FIG. 4, solid ink pellets 78 arrive at ink melting assembly 38 that includes a melt device 60. Typical melt devices are metallic or ceramic plates that are heated by passing electrical current through a pattern of electrical conductive traces on the plate's surface. This type of heater may be an assembly of resistive traces and laminated insulating layers and may be affixed to a plate with adhesive. The melt device 60 is electrically connected to a controller 68 that selectively couples electrical current to the melt plate with reference to various factors that may include, for example, the printer's operational mode and the temperature of ink in the ink melting assembly 38. The melted ink is stored in a reservoir that may be integrated into the print head 56.

In the example of FIG. 4, the ink container 200 emits solid ink pellets 78 in response to having its auger and vaned rotor rotated by electromechanical actuator 64. A drive shaft of electromechanical actuator 64 engages the drive coupler 220 of the ink container 200. The coupler causes both the vaned rotor and auger in the in container 200 to rotate in response to the rotation of electromechanical actuator 64. This actuator is electrically connected to a controller 68 that controls when the actuator rotates in order to effectively supply ink to print head 56. When the actuator 64 activates, the ink container 200 releases solid ink pellets 78. When the ink container is removed, the auger disengages from the actuator 64 so the vaned rotor 212 of FIG. 2 remains stationary and solid ink pellets are prevented from escaping the ink container 200.

Melted ink may be dripped directly from the melt device into a receiving reservoir or it may flow or be conveyed through a non-pressurized channel. Alternative embodiments may employ sealed pathways for ink transfer through all or portions of the path leading to the printhead. When sealed sections are used, ink may be pressurized to facilitate rapid flow or other desirable performance, such as passing through a filter. In a color printer using more than one type of ink, a separate ink container 200 may be used for each ink color, and the multiple ink containers may each be inserted into the printer using the loader 28.

It will be appreciated that variations of the above-disclosed and other features and functions, or alternatives thereof, may by desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A container for delivering solid ink in a solid ink printer comprising:

a housing;

an opening in the housing through which solid ink pellets are expelled;

a first moveable member located within the housing proximate to the opening, the first moveable member being configured to move solid ink pellets through the opening in the housing; and an auger located within the housing, the auger being configured for movement by an electromechanical actuator to move solid ink pellets within the housing to the first moveable member to enable the first moveable member to expel solid ink pellets through the opening in the housing.

2. The container of claim 1 wherein the auger is mechanically coupled to the first moveable member to enable the first moveable member and the auger to be rotated with a single actuator.

3. The container of claim 1 wherein the first moveable member is a moveable gate that selectively blocks the opening in the housing.

4. The container of claim 1 further comprising:

a restrictor configured to regulate a flow of solid ink pellets from the auger to the first moveable member.

5. The container of claim 1 wherein the first moveable member is configured to release a predetermined volume of solid ink units through the opening in the housing.

6. The container of claim 1 further comprising:

a coupler configured to couple an output shaft of an actuator to the first moveable member and the auger to enable rotation of the first moveable member and the auger.

7. A container for delivering solid ink in a solid ink printer comprising:

a housing;

an opening in the housing through which solid ink pellets are expelled;

a rotating vane located within the housing proximate to the opening, the rotating vane being configured to move solid ink pellets through the opening in the housing and to selectively block the opening in the housing; and a second moveable member located within the housing, the second moveable member being configured to move solid ink pellets within the housing to the first moveable member to enable the first moveable member to expel solid ink pellets through the opening in the housing.

8. The container of claim 7 wherein the second moveable member is a conveyor that is moved by an electromechanical actuator.

9. The container of claim 8 wherein the conveyor is an auger.

10. The container of claim 8 wherein the conveyor is an endless belt.

11. A solid ink printer comprising:

a melting device configured to melt solid ink pellets and produce liquid ink for printing; and a solid ink container, the solid ink container being configured to mount selectively to the solid ink printer to enable the container to be removed from the solid ink printer and reinstalled, the solid ink container comprising:

a housing having a volume in which solid ink pellets are stored;

an opening in the housing through which solid ink pellets are expelled for delivery of the solid ink pellets to the melting device;

a first moveable member located within the housing proximate to the opening, the first moveable member being configured to move solid ink pellets through the opening; and a second moveable member configured to move solid ink pellets within the housing to the first moveable member to enable the first moveable member to expel solid ink pellets through the opening in the housing.

12. The printer of claim 11 wherein the second moveable member is mechanically coupled to the first moveable member to enable the first and the second moveable members to be rotated with a single actuator positioned within the solid ink printer.

13. The printer of claim 11 wherein the second moveable member is a conveyor that is moved by an electromechanical actuator positioned external of the container, but within the solid ink printer.

14. The printer of claim 13 wherein the conveyor is an auger.

15. The printer of claim 13 wherein the conveyor is an endless belt.

16. The printer of claim 11 wherein the first moveable member is a moveable gate that selectively blocks the opening of the housing.

17. The printer of claim 16 wherein the moveable gate is a rotating vane.

18. The printer of claim 11, the solid ink container further comprising:

a restrictor configured to regulate a flow of solid ink units from the second moveable member to the first moveable member.

19. The printer of claim 11, the solid ink container further comprising:

a coupler configured to couple an output shaft of an actuator that is external to the housing of the container to the first moveable member and the second moveable member to enable rotation of the first moveable member and the second moveable member.

20. The printer of claim 11, the solid ink container further comprising:

another opening in the housing; and a removable closure configured to close the other opening selectively, the other opening being positioned in the housing to enable refilling of the container with solid ink pellets.

* * * * *